US007150922B2

(12) United States Patent
Spitsberg et al.

(10) Patent No.: US 7,150,922 B2
(45) Date of Patent: Dec. 19, 2006

(54) BETA-PHASE NICKEL ALUMINIDE OVERLAY COATINGS AND PROCESS THEREFOR

(75) Inventors: Irene Spitsberg, Loveland, OH (US); Joseph David Rigney, Milford, OH (US); Ramgopal Darolia, West Chester, OH (US); Elissa Hae-Kyung Lee, Cincinnati, OH (US); Jeffrey Allan Pfaendtner, Blue Ash, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/248,056

(22) Filed: Dec. 13, 2002

(65) Prior Publication Data

Related U.S. Application Data

(63) Continuation-in-part of application No. 09/524,227, filed on Mar. 13, 2000.

(60) Provisional application No. 60/415,395, filed on Oct. 2, 2002.

(51) Int. Cl.
*B32B 15/04* (2006.01)
*F03B 3/12* (2006.01)

(52) U.S. Cl. ..... 428/632; 428/679; 428/680; 416/241 R

(58) Field of Classification Search ..... 428/621, 428/613, 610, 632, 650, 655, 679, 680, 678, 428/323; 416/241 R, 241 B
See application file for complete search history.

(56) References Cited

U.S. PATENT DOCUMENTS 4,084,025 A * 4/1978 Rairden
4,142,023 A * 2/1979 Bornstein et al.
4,414,249 A 11/1983 Ulion et al. ..... 427/248
4,512,817 A 4/1985 Duhl et al. ..... 148/522
5,116,691 A * 5/1992 Darolia et al.
5,645,893 A 7/1997 Rickerby et al. ..... 427/405
6,042,898 A 3/2000 Burns et al. ..... 427/534
6,153,313 A * 11/2000 Rigney et al.
6,190,124 B1 2/2001 Freling et al. ..... 415/173.4
6,221,512 B1 4/2001 Rickerby ..... 428/623
6,291,084 B1 * 9/2001 Darolia et al.
6,340,500 B1 * 1/2002 Spitsberg
6,365,236 B1 4/2002 Maloney ..... 427/585
6,482,469 B1 * 11/2002 Spitsberg et al.
6,485,792 B1 * 11/2002 Grylls et al.
6,565,672 B1 5/2003 Spitsberg et al. ..... 148/277

(Continued)

*Primary Examiner*—Jennifer McNeil
(74) *Attorney, Agent, or Firm*—David L. Narciso; Gary M. Hartman; Domenica N. S. Hartman

(57) ABSTRACT

A beta-phase nickel aluminide (NiAl) overlay coating (24) and method for modifying the grain structure of the coating (24) to improve its oxidation resistance. The coating (24) is deposited by a method that produces a grain structure characterized by grain boundaries (44) exposed at the outer coating surface (36). The grain boundaries (44) may also contain precipitates (40) as a result of the alloyed chemistry of the coating (24). During or after deposition, the overlay coating (24) is caused to form new grain boundaries (34) that, though open to the outer surface (36) of the coating (24), are free of precipitates or contain fewer precipitates (40) than the as-deposited grain boundaries (44). New grain boundaries (34) are preferably produced by causing the overlay coating (24) to recrystallize during coating deposition or after deposition as a result of a surface treatment followed by heat treatment.

8 Claims, 2 Drawing Sheets

U.S. PATENT DOCUMENTS 6,571,857 B1 * 6/2003 Darolia et al.
6,572,981 B1 * 6/2003 Spitsberg
6,579,627 B1 * 6/2003 Darolia et al.
6,607,789 B1 * 8/2003 Rigney et al.
6,620,524 B1 * 9/2003 Pfaendtner et al.
2003/0041926 A1 3/2003 Spitsberg et al. ..... 148/516

* cited by examiner

BETA-PHASE NICKEL ALUMINIDE OVERLAY COATINGS AND PROCESS THEREFOR

CROSS REFERENCE TO RELATED APPLICATIONS

This application is a continuation-in-part patent application of co-pening U.S. patent application Ser. No. 09/524,227, filed Mar. 13, 2000, and claims the benefit of U.S. Provisional Application No. 60/415,395, filed Oct. 2, 2002.

BACKGROUND OF INVENTION

1. Field of the Invention

This invention relates to protective coating systems for components exposed to high temperatures, such as the hostile thermal environment of a gas turbine engine. More particularly, this invention is directed to a beta-phase nickel aluminide overlay coating whose grain structure is modified to improve oxidation resistance.

2. Description of the Related Art

Higher operating temperatures for gas turbine engines are continuously sought in order to increase their efficiency. However, as operating temperatures increase, the high temperature durability of engine components must correspondingly increase. Significant advances in high temperature capabilities have been achieved through the formulation of nickel and cobalt-base superalloys. Nonetheless, when used to form components of the turbine, combustor and augmentor sections of a gas turbine engine, superalloys can be susceptible to damage by oxidation and hot corrosion attack and may not retain adequate mechanical properties. For this reason, turbine, combustor and augmentor components are often protected by an environmental and/or thermal-insulating coating, the latter of which is termed a thermal barrier coating (TBC) system.

Environmental coatings that have been widely employed to protect gas turbine engine components include overlay coatings such as MCrAlX (where M is iron, cobalt and/or nickel, and X is yttrium or another rare earth element), and diffusion aluminide coatings, particularly those containing platinum aluminide (Ni(Pt)Al) intermetallic. The aluminum content of these materials provides for the slow growth of a strong adherent and continuous aluminum oxide layer (alumina scale) at elevated temperatures, which protects the coating and its underlying substrate from oxidation and hot corrosion. As apparent from their names, overlay and diffusion coatings are distinguishable in terms of the processes by which they are formed and the thickness of the zone of chemical interaction that occurs within the substrate surface beneath the coating. This zone, referred to as a diffusion zone (DZ), results from the interdiffusion between the coating and substrate. The diffusion zone beneath an overlay coating is typically much thinner than the diffusion zone created within a diffusion bond coat. Diffusion aluminide coatings are also distinguished from overlay coatings, in that the former consists of intermetallic compounds that form as a result of interdiffusion, while the latter can be multi-phase, containing phases such as gamma ($\gamma$) and beta ($\beta$) nickel aluminide structures if the substrate is a nickel-base superalloy.

Ceramic materials such as zirconia ($ZrO_2$) partially or fully stabilized by yttria ($Y_2O_3$), magnesia (MgO) or other oxides, are widely used as thermal barrier coatings (TBC's), or topcoats, on gas turbine engine components. To be effective, TBC's must strongly adhere to the component surface and remain adherent throughout many heating and cooling cycles. The latter requirement is particularly demanding due to the different coefficients of thermal expansion between TBC materials and the superalloys typically used to form turbine engine components. TBC systems capable of satisfying the above requirements have generally required a bond coat, typically formed of one or both of the above-noted diffusion aluminide and MCrAlX coatings. In addition to protecting the bond coat and underlying substrate from oxidation and hot corrosion, the alumina scale that grows on diffusion aluminide and MCrAlX coatings serves to chemically bond a ceramic layer to the bond coat. A thermal expansion mismatch exists between metallic bond coat materials, the alumina scale and ceramic layer, which results in stresses at their interfaces. Over time, microcracking and damage increase, eventually leading to spallation of the TBC.

In view of the above, it can be appreciated that bond coats have a considerable effect on the spallation resistance of the TBC, and therefore TBC system life. Consequently, improvements in TBC life have been sought through modifications to the chemistries of existing bond coat materials. Other types of bond coat materials have also been proposed, such as beta-phase nickel aluminide (NiAl) overlay coatings that have also found use as environmental coatings. The NiAl beta phase is an intermetallic compound that exists for nickel-aluminum compositions containing about 30 to about 60 atomic percent aluminum. Notable examples of NiAl coating materials are disclosed in commonly-assigned U.S. Pat. No. 5,975,852 to Nagaraj et al., U.S. Pat. No. 6,291,084 to Darolia et al., U.S. Pat. No. 6,153,313 to Rigney et al, and U.S. Pat. No. 6,255,001 to Darolia. These NiAl alloys, which preferably contain a reactive element (such as zirconium) and/or other alloying constituents (such as chromium), have been shown to improve the adhesion of a ceramic TBC layer, thereby increasing the service life of the TBC system.

In addition to modifications to their chemistry, the effect of the surface finish of diffusion aluminide and MCrAlY bond coats on TBC spallation resistance has also been investigated, as evidenced by U.S. Pat. No. 4,414,249 to Ulion et al. with respect to MCrAlY overlay coatings, and commonly-assigned U.S. Pat. No. 6,340,500 to Spitsberg and co-pending U.S. patent application Ser. No. 09/524,227 to Spitsberg with respect to diffusion aluminide coatings. Ulion et al. disclose that TBC service life can be improved by polishing the surface of a peened and heat-treated MCrAlY overlay bond coat. The benefit of peening is said to be increased density of the bond coat. The Spitsberg patent and patent application teach that the benefit of improving the surface finish of a diffusion aluminide bond coat is that the resulting modified surface morphology of the bond coat eliminates or at least reduces oxidation and oxidation-induced convolutions at the alumina-bond coat interface. The Spitsberg patent further teaches that peening and then heat treating a diffusion aluminide bond coat can significantly improve TBC service life, particularly if the bond coat does not undergo recrystallization during heat treatment. In contrast, the pending Spitsberg application teaches that TBC service life is improved by recrystallizing a diffusion aluminide bond coat to eliminate the original grain boundaries, which is believed to have the effect of creating more stable grains and reducing the quantity of refractory phases at the grain boundaries.

The mechanism by which TBC spallation initiates can depend on the type of bond coat used. Spallation of TBC deposited on one of the aforementioned beta-phase NiAl overlay bond coats has been observed to occur by delamination of the alumina scale from the bond coat or TBC delamination from the alumina scale. However, the mechanism by which spallation initiates from an NiAl overlay bond coat differs from MCrAlX and diffusion aluminide bond coats as a result of differences in chemistry, microstructure and mechanical properties. For example, NiAl overlay bond coats are believed to exhibit a different spallation mechanism than diffusion aluminide bond coats as a result of having higher creep resistance and flow or yield strengths at elevated temperatures.

Though having the above-noted advantages, TBC service life on NiAl overlay bond coats containing zirconium and/or chromium has been found to be sensitive to Zr and Cr content. Therefore, improvements in TBC service life deposited on NiAl overlay bond coats would be desirable. However, possible modifications in chemistry, microstructure and mechanical properties that might achieve an improvement must take into account the unique characteristics of NiAl overlay coatings, including the mechanism by which TBC spallation is initiated on an NiAl overlay bond coat.

SUMMARY OF INVENTION

The present invention generally provides a beta-phase nickel aluminide (NiAl) overlay coating suitable for use as a bond coat for a thermal barrier coating (TBC) system, and further provides a method for modifying the grain structure of such a bond coat in order to improve the spallation resistance of the TBC system. NiAl overlay coatings of this invention are deposited by methods that conventionally produce a generally columnar grain structure in which grains, and therefore grain boundaries, extend through the bond coat, from the outer surface of the bond coat to the surface of the substrate on which the bond coat is deposited, such that grain boundaries are exposed at the bond coat surface. Methods by which bond coats of this invention are deposited are generally physical vapor deposition (PVD) techniques, including electron beam physical vapor deposition (EBPVD), sputtering and directed vapor deposition (DVD).

According to a preferred aspect of the invention, the spallation resistance of a TBC deposited on an NiAl overlay coating of a type described above can be improved by modifying the microstructure of the overlay coating, which if properly performed has been shown to improve the oxidation resistance of the overlay coating. The NiAl overlay coating is first deposited on a substrate surface to have grains with grain boundaries that are continuous through the overlay coating from an outer surface of the overlay coating to the surface of the substrate. As a result, the as-deposited grain boundaries of the overlay coating are exposed at the outer surface of the overlay coating. The as-deposited grain boundaries may contain precipitates as a result of the alloyed chemistry of the coating. A particular example is the addition of limited amounts of zirconium and optionally chromium in accordance with commonly-assigned U.S. Pat. No. 6,153,313 to Rigney et al, and U.S. Pat. No. 6,291,084 to Darolia et al. During or after deposition, the overlay coating is caused to form new grain boundaries that are open to the outer surface of the overlay coating, though many are not continuous through the coating. If precipitates were originally present in the overlay coating, the new grain boundaries contain fewer precipitates than the as-deposited grain boundaries. New grain boundaries can be obtained by causing the overlay coating to recrystallize as a result of the coating sustaining a sufficiently high temperature, either during deposition or in a post-deposition process during which some of the precipitates (if present) are preferably solutioned. For example, the coating may be deposited on a substrate maintained at a sufficiently high temperature so that recrystallization occurs during deposition. Another approach is to cold or warm work and then heat treat the coating at a temperature sufficient to cause recrystallization.

According to this invention, grain boundaries of an as-deposited NiAl overlay coating that are exposed at the coating surface are prone to accelerated oxidation, particularly if zirconium-containing precipitates are present within the grain boundaries. NiAl overlay coatings processed according to this invention are characterized by grains whose grain boundaries are open to the outer surface of the coating, but are less susceptible to oxidation as a result of the grain boundaries being relocated, such that any precipitates originally present in the as-deposited grain boundaries are within the grains and substantially reduced from the new grain boundaries. As a result, the oxidation resistance of the NiAl overlay coating is improved, corresponding to improved spallation resistance for a TBC deposited on the coating.

Other objects and advantages of this invention will be better appreciated from the following detailed description.

DETAILED DESCRIPTION

Figure 1:
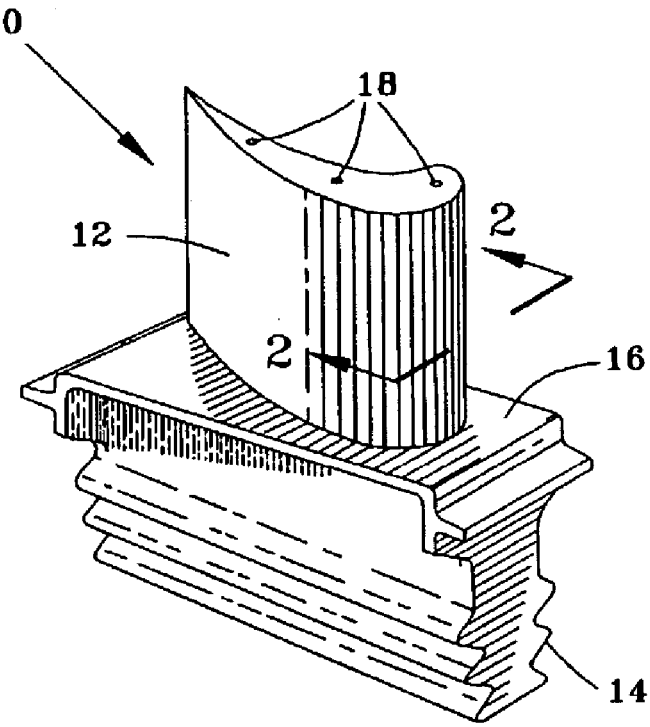
FIG. 1 is a perspective view of a high pressure turbine blade.

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to severe attack by oxidation, corrosion and erosion. The airfoil 12 is anchored to a turbine disk (not shown) with a dovetail 14 formed on a root section 16 of the blade 10. Cooling holes 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which a TBC system may be used to protect the component from its environment.

Figure 2:
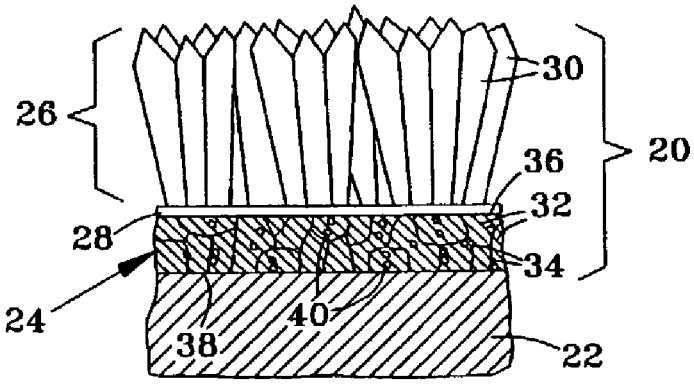
FIG. 2 is a cross-sectional representation of a TBC system on a surface region of the blade of FIG. 1 along line 2—2.

Represented in FIG. 2 is a thermal barrier coating (TBC) system 20 that includes an overlay bond coat 24 and a thermal-insulating ceramic layer, or TBC, on a superalloy substrate 22 that is typically the base material of the blade 10 in FIG. 1. Suitable materials for the substrate 22 (and therefore the blade 10) include equiaxed, directionally-solidified and single-crystal nickel and cobalt-base superalloys. The bond coat 24 adheres the ceramic layer 26 to the substrate 22 through the growth of an alumina scale 28 when the bond coat 24 is exposed to an oxidizing atmosphere, such as during high temperature exposures in air and deposition of the ceramic layer 26. As shown, the ceramic layer 26 has a strain-tolerant grain structure of columnar grains 30 achieved by depositing the ceramic layer 26 using physical vapor deposition techniques known in the art, such as EBPVD. A preferred material for the ceramic layer 26 is an yttria-stabilized zirconia (YSZ), a preferred composition being about 4 to about 8 weight percent yttria, though other ceramic materials could be used, such as yttria, nonstabilized zirconia, or zirconia stabilized by magnesia, ceria, scandia or other oxides. The ceramic layer 26 is deposited to a thickness that is sufficient to provide the required thermal protection for the underlying substrate 22 and blade 10, generally on the order of about 75 to about 300 micrometers.

As an overlay coating, little interdiffusion occurs between the bond coat 24 and the substrate 22 during deposition as well as any subsequent heat treatments (if employed). According to a preferred aspect of the invention, the bond coat 24 is formulated in accordance with commonly assigned U.S. Pat. No. 6,153,313 to Rigney et al, and U.S. Pat. No. 6,291,084 to Darolia et al., and therefore contains beta-phase NiAl intermetallic, zirconium and optionally chromium or another element disclosed in Rigney et al. or Darolia et al. For example, the bond coat 24 may contain, in atomic percent, about 30% to about 60% aluminum, about 0.1% to about 1.2% zirconium, optionally up to about 15% chromium, the balance essentially nickel. A thickness of about 50 micrometers is suitable for the bond coat 24 to protect the underlying substrate 22 and provide an adequate supply of aluminum for oxide formation, though thicknesses of about 10 to about 125 micrometers are believed to be acceptable.

Figure 3:
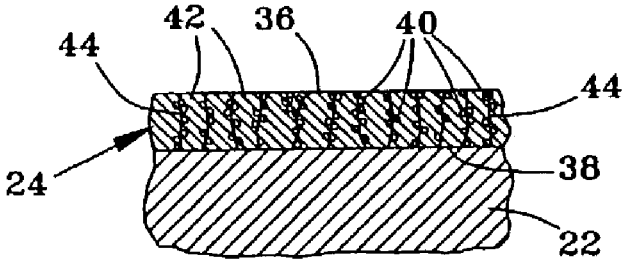
FIG. 3 is a cross-sectional representation of an NiAl overlay bond coat of the TBC system shown in FIG. 2, but in the as-deposited condition.

The bond coat 24 is represented in FIG. 2 as having been deposited and processed in accordance with this invention so that any precipitates 40 within the bond coat 24 are located primarily within the grains 32 of the bond coat 24, but largely absent from the grain boundaries 34 that intersect the surface 36 of the bond coat 24. In contrast, FIG. 3 represents the overlay bond coat 24 as it would appear if deposited and processed in accordance with conventional practice, e.g, in an as-deposited condition without any additional treatment provided by the present invention. The type of microstructure represented in FIG. 3 is typical of NiAl overlay coatings deposited by PVD, such as EBPVD. In FIG. 3, the bond coat 24 is characterized by grains 42 that extend through the bond coat 24, from the surface 36 of the bond coat 24 to the surface 38 of the substrate 22, such that the grains 42 are generally columnar with a larger aspect ratio than the grains 32 depicted in FIG. 2. As also represented, the grains 42 have grain boundaries 44 that intersect the surface 36 of the bond coat 24. The grain boundaries 44 that are open to the bond coat surface 36 are shown as being decorated with precipitates 40 formed during deposition of the bond coat 24 as would result from the presence of zirconium or another alloying constituent within the NiAl material.

As discussed below, the microstructure depicted in FIG. 2 is more resistant to oxidation than the microstructure depicted in FIG. 3, with the result that a TBC (the ceramic layer 26 in FIG. 2) deposited on the bond coat 24 of FIG. 2 is more resistant to spallation.

During an investigation leading to this invention, a study of TBC spallation mechanisms on NiAl bond overlay coats alloyed with zirconium (NiAl(Zr)) indicated that spallation typically initiated by either delamination of the oxide scale (e.g., scale 28 in FIG. 2) from the bond coat or by delamination of the TBC (e.g., ceramic layer 26 in FIG. 2) from the oxide scale. Notably, rumpling of the oxide scale, as occurs in diffusion aluminide bond coats, was not observed. This difference was theorized as being the result of improved creep resistance or yield strength of the NiAl(Zr) material, and/or the differences in the coating grain structure resulting from the different processing methods used to form overlay and diffusion coatings. While various properties of coating, including microhardness, strength and plasticity, are known to be effected by microstructure, it is believed that the influence that microstructure might have on oxidation, which leads to TBC spallation, has not.

The effect of grain structure was investigated, initially by altering the temperature at which NiAl(Zr) overlay bond coats were deposited by EBPVD. In the investigation, forty-one superalloy specimens were coated with a TBC system of the type shown in FIG. 2. The superalloys was RENÉ N5 with a nominal composition in weight percent of Ni-7.5Co-7.0Cr-6.5Ta-6.2Al-5.0W-3.0Re1.5Mo-0.15Hf-0.05C-0.004B-0.01Y. The bond coats were NiAl overlay coatings containing, by weight, about 22% aluminum, about 4 to about 7% chromium, and about 1% zirconium, the balance nickel and incidental impurities. The bond coats were deposited by EBPVD at deposition (substrate) temperatures of either about 500° C. or about 1000° C. and above. The ceramic topcoats were zirconia stabilized by about 7 weight percent yttria (7% YSZ), and all were deposited by EBPVD. The specimens were furnace cycle tested (FCT) at 2125° F. (about 1160° C.) at one-hour cycles within an oxidizing atmosphere, until TBC spallation occurred.

Significant scatter in cycles to spallation was observed for the specimens, ranging from less than fifty cycles to about 1100 cycles. The spalled specimens were examined using scanning electron microscopy (SEM) to determine their coating microstructures. A number of microstructural features were quantified, including grain morphology. It was observed that columnar grains (similar to that represented in FIG. 3) were typically present in coatings deposited at substrate temperatures of about 500° C., while equiaxed microstructures (similar to that represented in FIG. 2) were present in specimens whose deposition temperatures were about 1000° C. and above. The equiaxed specimens had a smaller average aspect ratio and exhibited little texture, indicating that the NiAl(Zr) overlay coatings had undergone recrystallization during deposition. Specimens with equiaxed grain structures were consistently found to exhibit significantly better resistance to spallation (above 600 cycles to spallation) than specimens with columnar grain structures.

In addition to grain morphology, a low state of residual stress in the grains was also associated with improved resistance to spallation. Average intragrain misorientation (AMIS) levels were measured by orientation imaging microscopy (OIM) using a scanning electron microscope (SEM) and evaluating backscattered electron patterns over a number of test points covering several grains. Low residual stress, or strain, levels, corresponding to measured AMIS of less than about 0.7 degrees, were typically found for the fully recrystallized overlay coatings that were associated with significantly improved spallation resistance.

In view of the above results, an additional number of specimens were prepared essentially identically to the original specimens, but with all of the NiAl(Zr) overlay bond coats being deposited at a temperature in the range of about 900° C. to about 1000° C., yielding recrystallized equiaxed grain structures. The specimens were evaluated using the same FCT conditions as before, with the result that the additional specimens were again consistently found to exhibit significantly better resistance to spallation than the original specimens as a whole, averaging about 560 cycles to spallation as compared to an average of about 81 cycles for specimens in the previous investigation. Examination of the specimens evidenced that they exhibited significantly better oxidation resistance than coatings deposited at lower temperatures.

From the above results, it was theorized that deposition (substrate) temperatures on the order of about 900° C. and higher, particularly 1000° C. and higher, cause bulk recrystallization during coating deposition, yielding an equiaxed NiAl overlay coating that is more resistant to oxidation than an as-deposited NiAl overlay coating having columnar grains.

Figure 4:
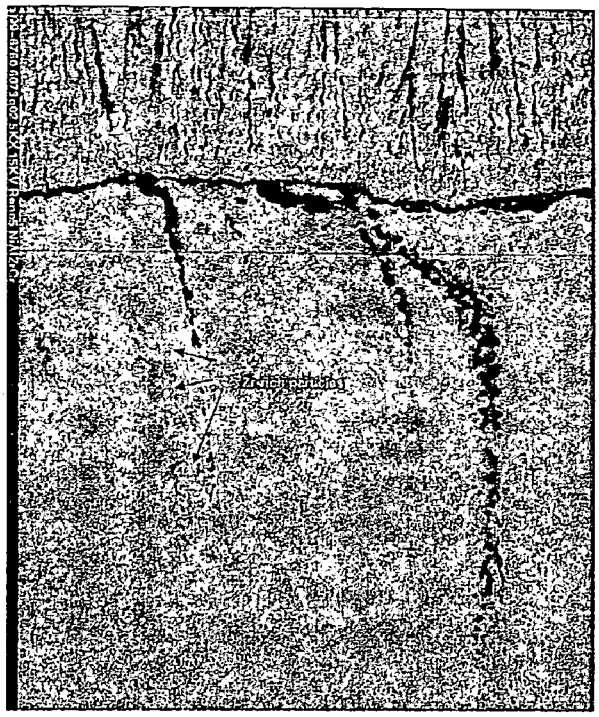
FIGS. 4 and 5 are scanned images of an NiAl(Zr) overlay bond coat of a TBC system, shown in FIG. 4 in the as-deposited condition and shown in FIG. 5 following thermal cycling in an oxidizing atmosphere.

Further examination of specimens having columnar and equiaxed microstructures showed that a large number of zirconium-rich precipitates decorated the grain boundaries of the columnar NiAl(Zr) coatings (deposited below about 870° C.), as represented in FIG. 3. FIG. 4 is a pre-FCT scanned image of a specimen having a columnar microstructure, with Zr-rich particles being clearly evident in the grain boundaries (referred to as leaders) open to the coating surface. In contrast, zirconium-rich precipitates within the equiaxed NiAl(Zr) coatings (e.g., deposited at about 1000° C. and higher) were located primarily within the grains and not the grain boundaries, particularly the leader boundaries open to the coating surface, as represented in FIG. 2.

Figure 5:
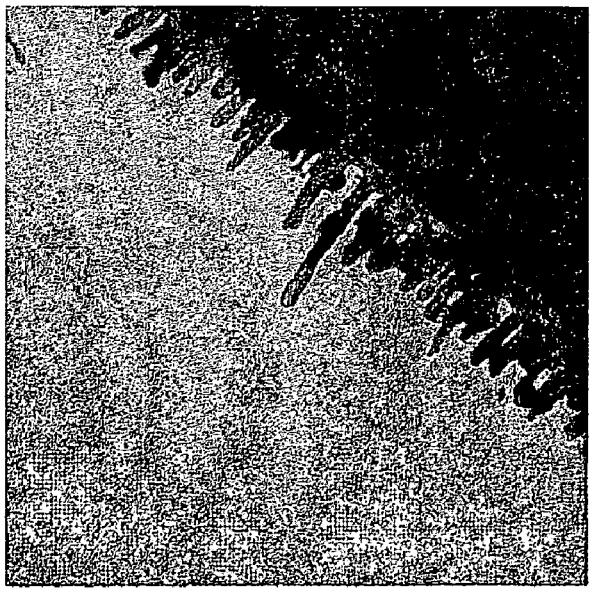

For the columnar coatings, it appeared the Zr-rich precipitates in the leader boundaries were very detrimental to the oxidation resistance of the coatings, presumably because of accelerated oxidation at the leader boundaries. Increased oxide growth rates corresponded to depletion of aluminum and zirconium in the surrounding matrix, resulting in the formation of spinel-type oxides and other oxides that are not adherent to the bond coat. A specimen processed in accordance with the above to have an NiAl overlay with a columnar microstructure (as a result of being deposited at a temperature of about 870° C.), was exposed to an oxidizing atmosphere for about one hundred-twenty hours at a temperature of about 2150° F. (about 1180° C.). Upon examination, it was determined that oxidation had occurred via the leader boundaries, allowing for accelerated oxidation through the coating thickness FIG. 5 is a scanned image of a specimen processed in accordance with the above to have an NiAl overlay with a columnar microstructure as a result of being deposited at a temperature of about 870° C., and after exposure to an oxidizing atmosphere for about one hundred-twenty hours at a temperature of about 2150° F. (about 1180° C.). From FIG. 5, it can be seen that oxidation occurred via the leader boundaries, allowing for accelerated oxidation through the coating thickness.

From the above, it was concluded that the oxidation resistance of an NiAl overlay bond coat, and therefore the spallation resistance of a TBC deposited on the bond coat, could be achieved by eliminating grain boundaries (leaders) that are open to the coating surface and by eliminating decorated with Zr-rich precipitates. The investigations into the effects of deposition temperature indicated that this object could be at least partially accomplished through the use of deposition temperatures above 1000° C., possibly as low as about 900° C., but preferably above 1050° C., at which recrystallization of NiAl coatings occurs during deposition by PVD processes.

The upper limit for deposition temperatures required to produce the desired equiaxed microstructure is generally limited by superalloy gamma-prime solutioning and melting temperatures, necessitating tight control of the process temperature. It was theorized that similar improvements in oxidation resistance of NiAl overlay coatings might also be achieved with coatings deposited at lower substrate temperatures, but then caused to recrystallize by suitable post-deposition processing. For example, recrystallization can be induced by a surface mechanical treatment that introduces cold working into the bond coat, so that at least the surface if not the entire overlay coating undergoes recrystallization when sufficiently heated to drive the recrystallization process. For this purpose, sufficiently intense peening is believed to be necessary, followed by a heat treatment at a temperature of about 1000° C., such as about 980° C. to about 1020° C. for a duration of about 0.5 to about 4 hours in an inert or otherwise low-oxygen atmosphere. Recrystallization is expected to be dependent on peening intensity (cold working), such that a sufficient peening intensity would be critical to achieving improved oxidation resistance by way of recrystallization. For this reason, shot peening with full surface coverage and an intensity of at least 6A is believed to be necessary to produce an NiAl overlay coating having equiaxed grains. Notably, previous uses of peening to densify overlay coatings and close leader boundaries would not result in the recrystallization effect sought by the present invention. While shot peening is a particularly suitable cold and warm working technique because it can be readily controlled and characterized in terms of stresses distribution, it is foreseeable that other cold working techniques could be used.

An additional benefit to producing equiaxed microstructures through post-deposition processing is the potential to reduce the quantity of Zr-rich precipitates within the coating. Specifically, it is believed that a post-deposition heat treatment at temperatures of about 980° C. or more in a low-oxygen atmosphere (less than $10^{-3}$ torr) should result in the dissolution of at least some of the Zr-rich precipitates, thereby further reducing the likelihood that such precipitates will be present at the leader boundaries. It is further believed that the remaining precipitates 40 will be reduced in size during the heat treating step.

While the invention has been described in terms of a preferred embodiment, it is apparent that other forms could be adopted by one skilled in the art. Therefore, the scope of the invention is to be limited only by the following claims.

The invention claimed is:

1. A beta-phase nickel aluminide overlay coating on a surface of a substrate, the overlay coating having a composition comprising beta-phase NiAl intermetallic and at least one reactive alloying constituent, the overlay coating comprising grains that are predominantly equiaxed and define grain boundaries that are open to an outer surface of the overlay coating, the overlay coating further comprising reactive element-rich precipitates within the grains, the precipitates being substantially absent from the grain boundaries that are open to the outer surface of the overlay coating.

2. A beta-phase nickel aluminide overlay coating according to claim 1, wherein the composition of the overlay coating consists of beta-phase NiAl intermetallic, zirconium as the at least one reactive element, and precipitates thereof.

3. A beta-phase nickel aluminide overlay coating according to claim 1, wherein the composition of the overlay coating consists of, in atomic percent, about 30% to about 60% aluminum, about 0.1% to about 1.2% zirconium, optionally up to about 15% chromium, and the balance essentially nickel.

4. A beta-phase nickel aluminide overlay coating according to claim 1, further comprising a ceramic coating on the overlay coating, wherein the overlay coating is a bond coat of a thermal barrier coating system.

5. A beta-phase nickel aluminide overlay coating of a thermal barrier coating system on a surface of a superalloy component, the overlay coating bonding a ceramic coating to the surface, the overlay coating having a composition comprising beta-phase NiAl intermetallic and zirconium, the overlay coating comprising grains that define grain boundaries that are open to an outer surface of the overlay coating, the grains of the overlay coating being predominantly equiaxed and substantially free of columnar grains with grain boundaries that are open to the outer surface of the overlay coating and extend through the overlay coating, the overlay coating further comprising zirconium-containing precipitates within the grains, the precipitates being substantially absent from the grain boundaries that are open to the outer surface of the overlay coating.

6. A beta-phase nickel aluminide overlay coating according to claim 5, wherein the overlay coating further contains chromium.

7. A beta-phase nickel aluminide overlay coating according to claim 5, wherein the overlay coating consists of, in atomic percent, about 30% to about 60% aluminum, about 0.1% to about 1.2% zirconium, optionally up to about 15% chromium, and the balance essentially nickel.

8. A beta-phase nickel aluminide overlay coating according to claim 5, wherein the composition of the overlay coating consists of beta-phase NiAl intermetallic, zirconium, optionally one or more additional alloying constituents, and precipitates thereof.

* * * * *